United States Patent [19]

Blake et al.

[11] 4,406,753

[45] Sep. 27, 1983

[54] ELECTROLYTIC METAL RECOVERY CELL AND OPERATION THEREOF

[75] Inventors: Colin C. Blake, Rochford; Charles C. O. Goodall, Ilford, both of England

[73] Assignee: Ciba-Geigy AG, Basel, Switzerland

[21] Appl. No.: 456,872

[22] Filed: Jan. 10, 1983

[30] Foreign Application Priority Data

Jan. 19, 1982 [GB] United Kingdom ..... 8201367
Mar. 11, 1982 [GB] United Kingdom ..... 8207061

[51] Int. Cl.[3] ..... C25D 1/20; C25D 17/12

[52] U.S. Cl. ..... 204/10; 204/109; 204/212; 204/216; 204/272

[58] Field of Search ..... 204/10, 109, 212, 272, 204/275, 216, 218, 231

[56] References Cited

U.S. PATENT DOCUMENTS

| | | | |
|---|---|---|---|
| 1,254,056 | 1/1918 | Moore | 204/10 |
| 1,535,577 | 4/1925 | Cleave . | |
| 1,959,376 | 5/1934 | Lucas | 204/10 |
| 3,560,366 | 2/1971 | Fisher | 204/212 |
| 4,292,163 | 9/1981 | King | 204/275 |

FOREIGN PATENT DOCUMENTS

| | | | |
|---|---|---|---|
| 556000 | 4/1958 | Canada | 204/10 |
| 2607512 | 9/1976 | Fed. Rep. of Germany | 204/10 |
| 2449734 | 2/1980 | France . | |
| 253958 | 7/1926 | United Kingdom | 204/10 |
| 1505736 | 3/1978 | United Kingdom . | |
| 2051862 | 1/1981 | United Kingdom | 204/109 |

OTHER PUBLICATIONS

Gabe, Journal of Applied Electrochemistry 4, 91–108, (1974).

*Primary Examiner*—Howard S. Williams
*Assistant Examiner*—Terryence Chapman
*Attorney, Agent, or Firm*—Harry Falber

[57] ABSTRACT

An electrolytic metal recovery cell is described in which a cylindrical cathode is mounted for rotation in a housing having an inlet and outlet for solution from which metal is to be recovered. The housing contains an anode and a cutter blade is mounted so as to be capable of removing metal deposited over the whole face of the cathode when the cell is in use. In order to control the operation of the cell, electrical means are provided for operating the cutter blade at predetermined intervals of time irrespective of the electrolysis conditions and for operating the cutter blade when a monitored cathode potential deviates a predetermined amount from a desired value.

By this means the use of previously proposed scrapers and their attendant disadvantages are avoided and the cell can be easily controlled either under steady state electrolytic conditions or even when there are large variations in the concentration of the metal ions in solution.

The cell and its operation are described for use in the recovery of silver from spent photographic fixing solutions but may be used to recover metals other than silver.

10 Claims, 3 Drawing Figures

ELECTROLYTIC METAL RECOVERY CELL AND OPERATION THEREOF

FIELD OF THE INVENTION

This invention relates to an electrolytic metal recovery cell and to the operation thereof.

PRIOR ART

An article by D. R. Gabe in the Journal of Applied Electrochemistry 4, (1974), 91-108, describes a rotating cylinder electrode for use as an electrolytic cell for the recovery of metals. Other electrolytic cells employing a rotating cathode have been described in U.S. Pat. Nos. 1,535,577 and 3,560,366 and French Patent Specification No. 2,449,734.

A method of using an electrolytic cell with a rotating cylinder cathode is described in British Patent Specification No. 1,505,736, the cell being used in such a way as to cause the metal to deposit on the rotating cylinder cathode in powder form. The cell has a cylindrical cathode mounted for rotation in a housing having an inlet and outlet for solution from which metal is to be recovered, the housing containing an anode and means for removing metal deposited in powder form on the cathode. The cell described in this British Patent Specification has been used commercially, particularly for the recovery of silver from used photographic processing solutions. When the cell is used in the manner described in the Patent Specification, the silver collects as a powdery deposit on the rotating cathode and is removed by a scraper which engages the cathode as it is rotated. However, the method of removing the powdery deposit of metal from the rotating cathode using a scraper is not particularly efficient and indeed the use of a scraper entails some disadvantages, especially since build-up of metal on the rotating cathode can strain the mounting of the scraper.

The aforesaid article by Gabe shows that the current density attainable on a rotating cylinder electrode is, to an approximation for a particular cell, given by the relationship:

$$I=K\cdot C\cdot V^{x}$$

where

I is the current in amps actually used in electro-deposition of the metal,

C is the concentration of the metal ion in moles per $cm^3$,

V is the peripheral velocity of the cylinder electrode, x is an exponent which under the conditions required to deposit the metal as powder is observed to be from 0.7 to 1.0, preferably 0.80 to 0.95, and K is a constant related to the dimensions of the cell.

It is clear from this relationship that the current carried by the cell varies with the concentration of metal and for a high concentration of metal can be reduced by (1) reducing the speed V of rotation of the cylinder, (2) using a smaller cathode thereby reducing the value of K, or (3) by reducing the value of x.

Varying the speed of rotation of the cylinder is not a practical solution as the concentration of metal would need to be monitored constantly and the value of V adjusted accordingly. The use of a cathode of smaller dimensions would result in a significant reduction in current at lower concentrations of metal but it is desirable that the maximum current be maintained at low concentration. It has been found that the reduction of the exponent x is the most effective means of compensating the current carried by the cell at high concentration and this is achieved by removing the deposited powder metal which results in a marked change in the effective area of the cathode surface. This removal is effected by the scraper in the cell described in the British Specification No. 1,505,736 and as the scraper continuously serves to remove the deposited metal powder substantial variation of the current is avoided.

As indicated above, the use of a scraper entails certain disadvantages but the absence of the scraper makes control of the cell difficult to achieve. It is an object of the invention to reconcile these two conflicting requirements.

BRIEF SUMMARY OF THE INVENTION

According to one aspect of the present invention there is provided an electrolytic metal recovery cell, comprising a housing; an inlet to said housing; an outlet to said housing; a cylinder cathode mounted for rotation in said housing; an anode within said housing; cutter means mounted in said housing adjacent said cathode; a cutter blade to said cutter means; drive means for moving said cutter blade from a rest position into engagement with metal deposited on said cathode for removing such metal from the whole face of the cathode during rotation thereof; timing means for operating said drive means at predetermined intervals irrespective of the conditions of electrolysis; means for monitoring a desired value of cathode potential with respect to a reference potential; means for generating an overriding signal when the monitored cathode potential deviates a predetermined amount from the desired value; and means for feeding said overriding signal to said drive means to operate the latter irrespective of the timing means.

According to another aspect of the present invention there is provided a method of controlling the operation of an electrolytic metal recovery cell, comprising the steps of contacting a rotating cylinder cathode with a solution comprising ions of the metal to be recovered under conditions such as to result in the electrodeposition of the metal on the rotating cathode in powder form, monitoring a desired value of cathode potential with respect to a reference potential, operating cutter means to remove metal deposited over the whole face of the cathode at predetermined time intervals irrespective of the cathode potential, and generating an overriding signal to operate said cutter means when the monitored cathode potential deviates a predetermined amount from said desired values.

The use of a cutting action in the present invention rather than a scraping action prevents the build-up of metal on the rotating cathode due to riding up of the scraper over harder or more adherent deposits which may arise. Operation of the cutter blade at predetermined time intervals will normally be sufficient to control the current provided that the time intervals are selected in dependence upon the parameters of the cell. However, in order to take into account possible fluctuations in the concentration of the metal ion or other changes in the electrolysis conditions, the cell is continuously monitored by monitoring the cathode potential and generating an overriding signal when the monitored potential deviates from a desired value. The overriding signal is then used to operate the cutter blade and restore the cell to the desired operating conditions irrespective of the normal timed operation of the timing means.

Other features and objects of the cell of the present invention and the operation thereof are to be found in the claims.

THE DRAWINGS

In order to enable the invention to be more readily understood, reference will now be made to the accompanying drawings, which illustrate diagrammatically and by way of example an embodiment thereof, and in which.

DESCRIPTION OF PREFERRED EMBODIMENTS

Figure 1:
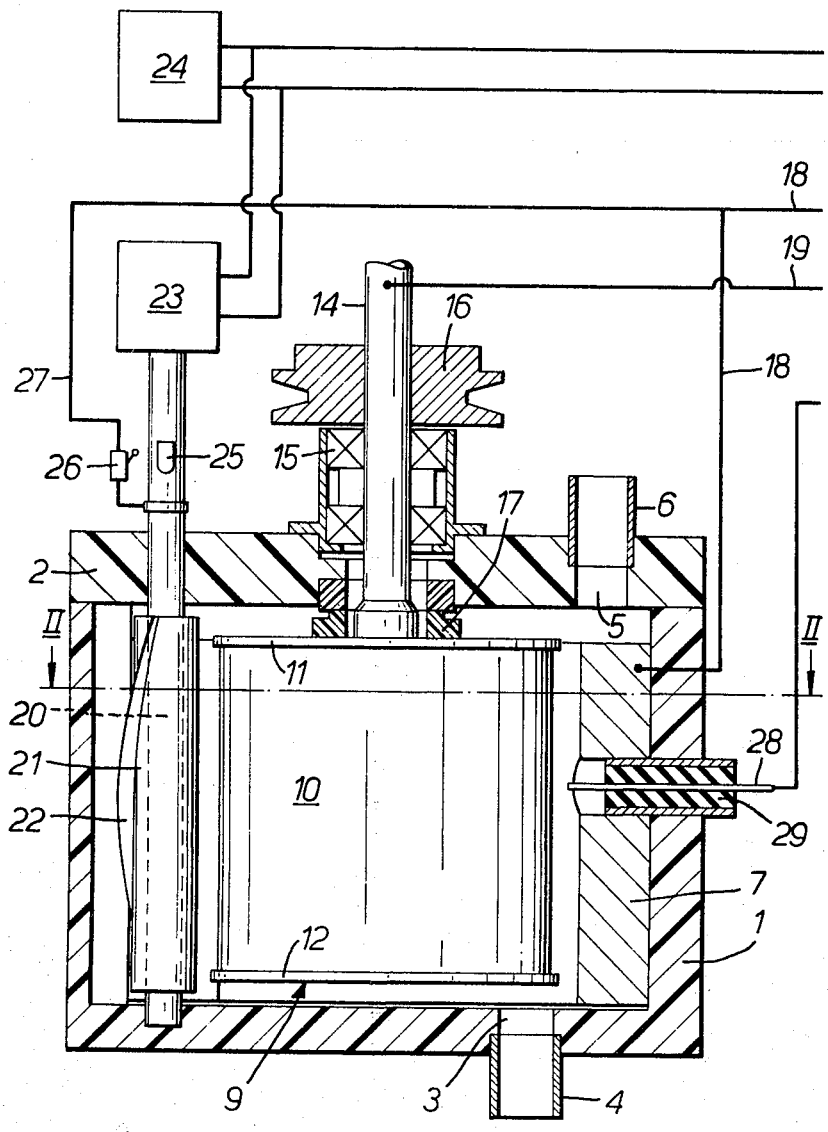
FIG. 1 is a vertical axial section through an electrolytic metal recovery cell.
Figure 2:
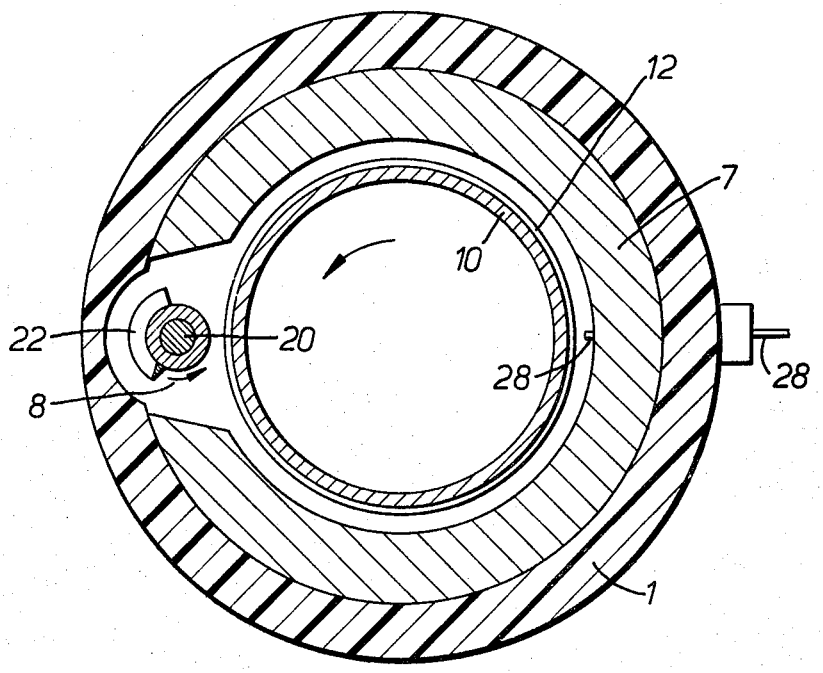
FIG. 2 is a horizontal section through the cell along the line II—II in FIG. 1.

Referring now in particular to FIGS. 1 and 2, there is shown an electrolytic metal recovery cell comprising a cylindrical cup shaped body 1 to which a lid 2 is fixed in a fluid-tight manner, the body and lid constituting an outer housing for the cell and preferably being made of plastics material, such as polyvinylchloride. The bottom of the body 1 is formed with a bore 3 into which is fitted an inlet 4 while the lid 2 is also formed with a bore 5 which is fitted with an outlet 6.

A substantially annular cylindrical graphite anode 7 is attached to the inner wall of the body 1 coaxial therewith. The anode is formed with an aperture 8 so that, in plan view, it has substantially the shape of a horseshoe.

A cylindrical cathode 9 is rotatably mounted in the cell housing, the cathode comprising a hollow stainless steel cylinder 10 provided at each end with plastics end caps 11 fitting snugly within the cylinder but leaving external flanges 12 of a diameter slightly greater than that of the cylinder. The cathode is mounted on a drive shaft 14 supported in bearings 15 mounted on the lid 2 and drivable from external drive means (not shown) via a pulley wheel 16. The drive shaft is sealed from the interior of the cell body 1 by face seals 17.

The anode 7 and cathode 10 are connected via electrical connections indicated at 18 and 19 respectively in FIG. 1 with a stabilised voltage supply as will be described hereinafter with reference to FIG. 3.

A rotatable cutter shaft 20 extends in axially parallel relationship with the drive shaft 14 and cathode 9, the shaft 20 passing through the lid 2 and lying substantially centrally of the anode aperture 8. The shaft 20 carries a cylindrical cutter holder 21 on which is mounted a cutter blade 22. The shaft 20 and holder 21 are preferably made of stainless steel and the cutter blade is made of stellite steel. The cutter blade is triangular in cross-section and extends in a helical path along the cutter holder. For reasons to be explained hereinafter, the helical path does not extend all round the periphery of the cutter holder but extends only around part of the periphery, preferably some 120° to 180°.

The shaft 20 is rotatable by means of an electric cutter motor 23 under the influence of a timing mechanism 24, and is provided with a cam 25 arranged to operate a microswitch 26 disposed in a line 27 leading from the anode connection 18 to the shaft 20, the arrangement being such that upon commencement of rotation of the shaft 20, the cam 25 operates the microswitch 26 to send a pulse of anode current through the shaft 20 and thus to the cutter blade 22.

A probe 28 of a saturated calomel electrode is passed through an aperture in the wall of the body 1 and a registering aperture in the anode 7 and is sealed in place by a seal 29. The end of the probe is secured a fixed distance from the cathode cylinder 10.

The cell voltage or electrode potential is controlled in known manner through a potentiostat, using the saturated calomel electrode as a reference electrode. FIG. 3 shows the circuit diagram of an electrical system for controlling the cell in this manner. The electrolytic recovery cell E is shown in outline in the middle of the Figure and comprises the anode 7, cathode 9 and cutter blade 22. The anode and cathode are electrically connected to a stabilised power supply SPS. A millivoltmeter MV displays a signal indicative of the potential difference between the potential of the calomel electrode as determined by the probe 28 and the generated potential at the cathode 9. The potential difference is also applied to a buffer amplifier BA and relayed by a feed back loop FBL to the stabilised power supply SPS. The buffer amplifier BA, feed back loop FBL and stabilised power supply SPS together constitute a potentiostat P which serves to stabilize the potential of the cathode 9 with respect to that of the calomel electrode.

Figure 3:
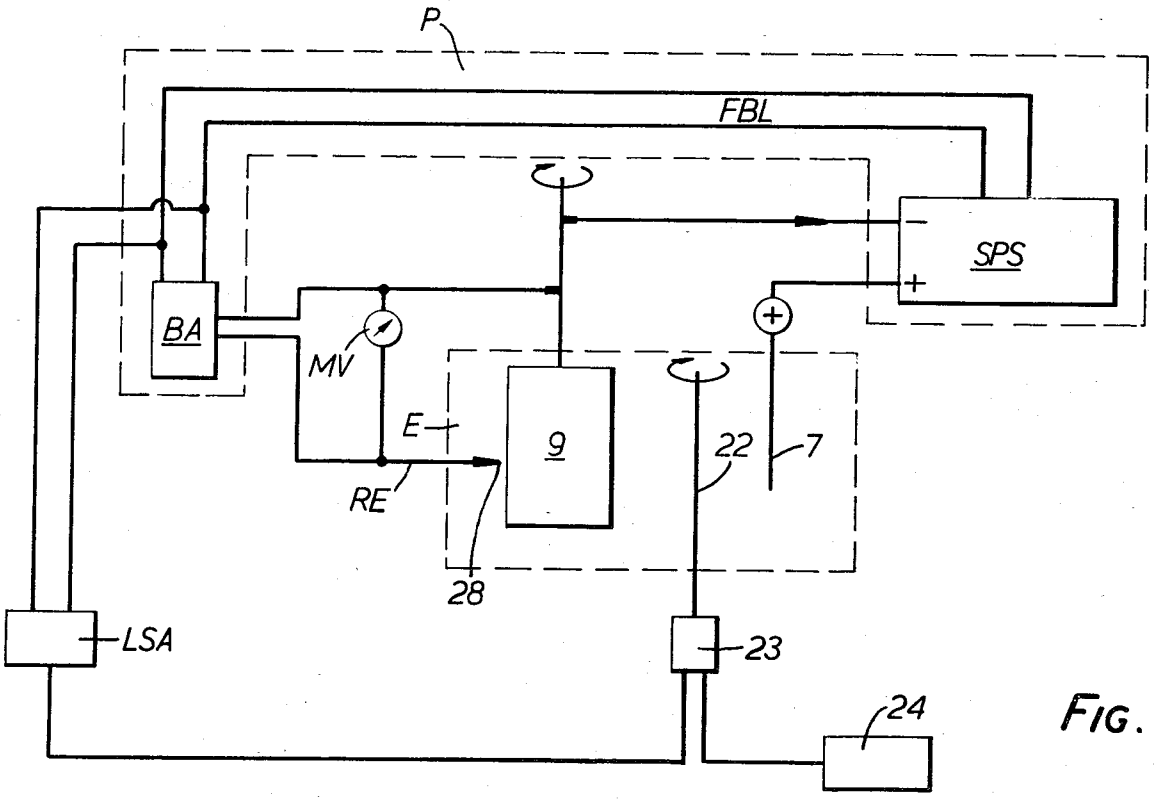
FIG. 3 is a circuit diagram.

The cutter blade 22 is shown in FIG. 3 as operable by the cutter motor 23 under the control of the timing mechanism 24 and also under the control of a limit switch amplifier LSA which is connected to the output of the buffer amplifier BA, and which is so arranged that when the probe potential falls below a limit set on the limit signal amplifier LSA, the limit signal amplifier actuates the cutter motor 23 irrespective of the state of the timing mechanism 24.

The electrolytic metal recovery cell described above is intended electrolytically to recover metal from a solution containing the metal and is particularly suitable for recovering silver metal from a spent photographic processing solution. The solution is introduced into the cell through the inlet 4 and leaves through the outlet 6, and may be recirculated until recovery is complete.

The cell utilises a rotating cylinder cathode 9 for the recovery and the operation of such a cathode has been described in the literature. Briefly, in the operation of such a cell, the cathode is rotated and metal is deposited thereon, the electrolytic conditions being such that the metal is deposited as a powder, which can be removed from the cathode. Deposition of the silver on the rotating cylinder cathode has the advantages that the cell may be constructed to have a high recovery capacity in respect of its size and that the powder may be easily removed from the rotating cylinder and subsequently isolated by filtration.

In setting up the present cell, the cell is filled with a silver salt solution and the electrolytic conditions are chosen so that upon rotation of the cathode a thin layer of silver is hard-plated thereon. The cell is then ready for operation and the solution to be treated is passed through the cell, the cathode is rotated and the electrolytic conditions are chosen such that the silver is deposited in powder form on the rotating cathode. At periodic intervals, as determined by the setting of the timing mechanism 24, the cutter motor 23 is operated to rotate the shaft 20 and cause the cutter blade 22 to remove the deposited silver powder from the cathode, the powder being flushed out of the cell through the outlet 6 to be collected in an appropriate filter.

FIG. 2 shows the cutter blade and shaft in a rest position and it will be seen that the cutter blade 22 extends helically about the part of the cutter holder 21 remote from the cathode. The radial distance from the centre of the cutter shaft 22 to the nearest point of the edge of the flange 12 of the end cap 11 is the same as the radial distance from the centre of the cutter shaft 22 to the outermost part of the cutter blade 22 so that when the cutter blade is rotated it will remove from the cathode cylinder 10 all deposited silver projecting beyond a cylinder defined by the edges of the flanges 12. In practice the flanges 12 project a distance sufficient to provide on the cylinder 10 the aforesaid hard-plated layer and a very thin residual layer of deposited powder. It will be appreciated that since the end caps 11 are made of plastics, the provision of exact dimensions for the flanges 12 is unnecessary because the first revolution of the cutter blade 22 will shave the flanges to the required diameter. The cathode is rotated at a constant speed which may be from 200 to 2,000 r.p.m. and in practice is preferably about 1,000 r.p.m. As the cathode rotates at a relatively fast speed, it will be appreciated that the slower the cutting blade rotates, the less likelihood there will be of the blade causing damage to the cathode. However, it is desirable to remove the deposited silver from the whole surface of the cathode as soon as possible so as to maintain the electrolytic conditions substantially uniform. A suitable period of rotation for the shaft 20 and cutting blade is from ¼ to 3 r.p.m. It will be appreciated that the timing mechanism 24 and cutter motor 23 are so arranged as to turn the shaft 20 through one or an integral number of revolutions, so that upon completion of their rotation, the cutter blade and shaft come back to the rest position shown in FIG. 2.

An important feature of the cutter blade is that whilst it is rotating and removing metal from the cathode point contact only is made between the blade and the metal. This reduces the stress on the blade and ensures that if the electrolytic conditions have not been correctly selected, or have fluctuated, and the silver has deposited on the cathode in plate form rather than powder form, such silver can be removed from the cathode by the blade.

Another feature which helps to affect the cutting stress is the pitch angle of the helical cutter blade about the cutter body 21, a larger pitch angle leading to a reduction in the stress. However, as indicated above it is required to leave a space between the cutter body 21 and the cathode to allow a layer of deposited metal to build up and into which the blade can cut. Therefore, the helical blade may not extend completely around the periphery of the cutter body and an extent of 120° to 180° has been found to be a suitable compromise between these two mutually exclusive requirements.

During deposition of the silver, it is unavoidable that some becomes deposited on the cutter blade and cutter holder. To prevent the build-up of such silver, each time the cutter shaft starts to rotate, the cam 25 operates the microswitch 26 to pass an anode pulse through the holder and blade so that any metallic silver which has been plated out of solution is redissolved into the solution. As shown in FIG. 1, the anode pulse is obtained directly from the anode.

It has been found that the most important factor in ensuring that the silver is electro-deposited as a powder is the operating potential of the rotating cylinder cathode. In order to ensure that the metal is deposited as a powder, it is necessary to keep the electrical potential on the rotating cylinder cathode at a constant value or within predetermined limits with respect to the reference electrode. This is effected by the potentiostat P which operates continuously to stabilize the potential of the cathode with respect to the reference electrode.

In order to produce a powder deposit of metal, the potential near the cathode as sensed by the probe of the reference electrode must be a given value above the cathode potential, depending upon the metal and the distance of the probe from the cathode surface. The probe 28 of the reference electrode RE is therefore located with its end as near as feasible from the surface of the cathode, i.e., the surface of the cylinder defined by the edges of the flanges 12, and as far away as possible from the influence of the anode.

During the deposition of the metal, the current used in the electrodeposition will increase as the metal builds up on the cathode or if the concentration of the metal in solution is suddenly increased. As the current increases an increased demand is made upon the power supply and it is only possible to continue electrodeposition by increasing the power supply. However, a potentiostat has limitations on the power output which can be achieved with it. Obviously as the power output of the potentiostat is increased, the cost of components used and the complexity of the design also increases. Therefore it is desirable to keep the power output as low as possible.

As shown above, the current used in the electrodeposition can be controlled by removing the deposited metal. Thus in the present cell control of the current is achieved by the operation of the cutter blade 22 and may be effected when a maximum preselected current value is reached. However, as the period within which this value is reached will vary depending, inter alia, upon the concentration of the metal, and as this may effect the depth and to some extent the type of deposit, the removal is effected in accordance with the invention by operation of the cutter blade at predetermined timed intervals chosen with a view to ensuring that the maximum preselected current is never reached.

However, sudden changes in concentration or other conditions might affect the cell to the extent that the maximum preselected current value is reached between the two consecutive operations of the cutter, with a consequent suppression of the power supply and a resulting suppression of the cathode potential with respect to the reference electrode. In order to avoid the occurrence of such a condition, the value of the cathode potential is monitored constantly by the millivoltmeter MV and a significant deviation from the desired operating potential generates through the buffer amplifier BA a signal which is fed to the limit switch amplifier LSA which directly operates the cutter motor 23 to cause the cutter blade to complete one or a whole number of revolutions until such time as the cathode potential is restored to the desired value.

Thus it can be seen that a very significant modulation of the current carried by the electrolytic cell can be achieved by this technique such that a wide range of metal ion concentrations in the solution to be treated can be accommodated without the necessity of extending the operating range of the D.C. power supply and potentiostat. It has been found that the present cell is capable of treating spent photographic fixing solutions containing relatively high concentrations of silver using only a moderate power supply. In the absence of a cutter blade operated as just described a very much larger power supply would be required to treat the same solutions with a consequent and significant increase in equipment cost.

It may be questioned as to why a lower output power supply fitted with a current limiting device is not employed. As pointed out above, however, such a technique would result in suppression of the cathode potential at increased metal ion concentrations. Continued operation of the cell at such a suppressed potential would no longer result in deposition of the metal as a powder. In the present invention the cathode potential is immediately restored to its desired value by operation of the cutter blade.

While the present invention has been particularly described with reference to the electro-deposition of silver in the recovery of silver from spent photographic fixing solutions, it is to be appreciated that the present invention is applicable to the electro-deposition, electrolytic recovery or electrowinning of metals other than silver.

We claim:

1. An electrolytic metal recovery cell, comprising a housing; an inlet to said housing; an outlet to said housing; a cylinder cathode mounted for rotation in said housing; an anode within said housing; cutter means mounted in said housing adjacent said cathode; a cutter blade to said cutter means; drive means for moving said cutter blade from a rest position into engagement with metal deposited on said cathode for removing such metal from the whole face of the cathode during rotation thereof; timing means for operating said drive means at predetermined intervals irrespective of the conditions of electrolysis; means for monitoring a desired value of cathode potential with respect to a reference potential; means for generating an overriding signal when the monitored cathode potential deviates a predetermined amount from the desired value; and means for feeding said overriding signal to said drive means to operate the latter irrespective of the timing means.

2. The cell of claim 1, wherein the cutter means comprises a shaft member rotatable by said drive means, the cutter blade extending for at least the length of said cathode and extending in a helical manner about part of the periphery of said shaft member, the blade being arranged such that in said rest position, the peripheral portion of the shaft member free of said blade is adjacent to but spaced from said cathode, and such that, upon turning said member, the blade is engageable to a predetermined depth with metal deposited on said cathode.

3. The cell of claim 2, wherein said blade extends helically for 120° to 180° of the periphery of said shaft member.

4. The cell of claim 2, wherein said shaft member consists of stainless steel and said blade of stellite steel.

5. The cell of claim 1, and further comprising means for anodically pulsing said cutter blade upon operation of said drive means.

6. The cell of claim 1, wherein said means for monitoring the desired value of cathode potential includes potentiostat means and a reference electrode.

7. A method of controlling the operation of an electrolytic metal recovery cell, comprising the steps of contacting a rotating cylinder cathode with a solution comprising ions of the metal to be recovered under conditions such as to result in the electrodeposition of the metal on the rotating cathode in powder form, monitoring a desired value of cathode potential with respect to a reference potential, operating cutter means to remove metal deposited over the whole face of the cathode at predetermined time intervals irrespective of the cathode potential, and generating an overriding signal to operate said cutter means when the monitored cathode potential deviates a predetermined amount from said desired values.

8. The method of claim 7, said cutter means comprising a drivable shaft member, and a cutter blade extending for at least the length of said cathode and extending in a helical manner about part of the periphery of said shaft member, wherein said cathode is rotated at from 200 to 2000 r.p.m., and said shaft member is rotated one complete revolution at said predetermined time intervals in from one quarter to three minutes.

9. The method of claim 7, and further comprising the step of anodically pulsing said cutter blade at the commencement of rotation of said shaft member.

10. The method of claim 7, wherein said metal is silver and said solution is spent photographic fixing solution.

* * * * *